US006140594A

United States Patent [19]

Ishikawa et al.

[11] Patent Number: 6,140,594

[45] Date of Patent: Oct. 31, 2000

[54] POSITION DETECTING APPARATUS FOR FORKLIFTS

[75] Inventors: Kazuo Ishikawa; Hiroyuki Fujimori, both of Kariya, Japan

[73] Assignee: Kabushiki Kaisha Toyoda Jidoshokki Seisakusho, Kariya, Japan

[21] Appl. No.: 09/199,581

[22] Filed: Nov. 25, 1998

[30] Foreign Application Priority Data

Nov. 28, 1997 [JP] Japan ..... 9-328754

[51] Int. Cl.[7] ..... H01H 3/16

[52] U.S. Cl. ..... 200/47; 200/61.41

[58] Field of Search ..... 200/47, 332.1, 200/61.41, 61.44; 187/223

[56] References Cited

U.S. PATENT DOCUMENTS

| | | | |
|---|---|---|---|
| 2,210,793 | 8/1940 | Butler | 200/47 |
| 3,296,392 | 1/1967 | Scott | 200/47 |
| 4,411,582 | 10/1983 | Nakada | 414/636 |
| 5,207,316 | 5/1993 | Sakamoto | 200/47 |

*Primary Examiner*—Renee Luebke
*Attorney, Agent, or Firm*—Morgan & Finnegan, L.L.P.

[57] ABSTRACT

A forklift has an inner mast parallel to an outer mast and a fork vertically movable in accordance with a vertical movement of the inner mast. An apparatus for detecting the vertical position of the fork has a lever that is displaced when engaged by the inner mast when the inner mast is located in a predetermined vertical region. The lever intersects the path of the inner mast. The apparatus also includes a switch that is actuated by the lever.

15 Claims, 7 Drawing Sheets

POSITION DETECTING APPARATUS FOR FORKLIFTS

BACKGROUND OF THE INVENTION

The present invention relates to an apparatus for detecting the position of an attachment employed in industrial vehicles such as forklift forks.

An industrial vehicle employs attachments to carry and transfer loads. For example, a forklift employs forks, which are supported by a forklift mast, to carry loads. It is important that the position of the forks be detected to guarantee vehicle stability.

A limit switch is often installed in a forklift to detect the position of the forks. The limit switch is actuated depending on whether the forks are located above or below a predetermined position.

A typical limit switch has a body on which an actuating piece, which is moved by external force, and a switch mechanism is arranged. Displacement of the actuating piece moves the switch mechanism and actuates the limit switch. That is, the limit switch is actuated (or de-actuated) when the actuating piece is displaced and de-actuated (or actuated) when the actuating piece returns to its original position. Once a detected body (e.g., forks) enters a certain zone defined either above or below a predetermined position, the actuating piece is kept displaced until the detected body moves out of the zone. In other words, the limit switch is either continuously actuated or continuously de-actuated when detecting the position of the detected body.

In a forklift, the body of the limit switch is fixed to an outer mast. A vertically elongated, plate-like dog for manipulating the actuating piece of the limit switch is fixed to an inner mast. The limit switch and the dog are arranged such that the dog moves the actuating piece to change the state of the limit switch when the forks are located above a predetermined position.

The space between the inner mast and the outer mast is narrow. Thus, the limit switch body cannot be arranged at a location that permits the inner mast to directly manipulate the actuating piece. The inner mast indirectly manipulates the actuating piece with the dog, which is secured to the inner mast. Accordingly, the dog is designed to manipulate the actuating piece of the limit switch appropriately.

However, such a limit switch results in the need for a dog formed exclusively in accordance with the maximum lifting height of each forklift type. This increases the number of parts and raises costs.

SUMMARY OF THE INVENTION

Accordingly, it is an objective of the present invention to provide a simple and inexpensive position detecting apparatus that directly detects the fork elevation.

To achieve the above objective, the present invention provides an apparatus for detecting a vertical position of a fork of a forklift vehicle. The vehicle has an outer mast, and an inner mast movable in a path parallel to the outer mast. The fork is vertically movable in accordance with vertical movement of the inner mast. The apparatus includes a housing secured to a rear surface of the outer mast. A lever is displaced when engaged by the inner mast when the inner mast is located in a predetermined vertical region. The lever intersects the path of the inner mast. A support shaft supports the lever. The support shaft is supported by the housing and is rotatable in a predetermined angular range between an initial position and an operation position. A spring biases the support shaft in a first rotational direction. The support shaft is rotated in a second rotational direction, opposite to the first rotational direction, when the lever is engaged by the inner mast. A switch is actuated by the lever. A switch actuator member is located on the support shaft and moves integrally with the support shaft. The switch actuator member actuates the switch when the support shaft is rotated in the first rotational direction. The switch actuator member de-actuates the switch when the support shaft is rotated in the second rotational direction.

Other aspects and advantages of the present invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A position detecting apparatus according to the present invention will now be described with reference to FIGS. 1 to 7. The position detecting apparatus, or position detector 1, is applied to a forklift. As shown in FIG. 2, a right outer mast 2 of the forklift has a rear surface 2*a*, which faces the forklift cabin, and a right surface 2*b*. The position detector 1 is coupled to the rear surface 2*a*. Loads are handled at the front side of the outer mast 2. This prevents interference between a load and the position detector 1 and thus prevents the detector 1 from being damaged. A support plate 3 is fixed to the right surface 2*b* such that it is flush with the rear surface 2*a*. An attachment plate 4 is fixed to the support plate 3 spanning the rear surface 2*a* of the outer mast 2 and the support plate 3.

Figure 1:
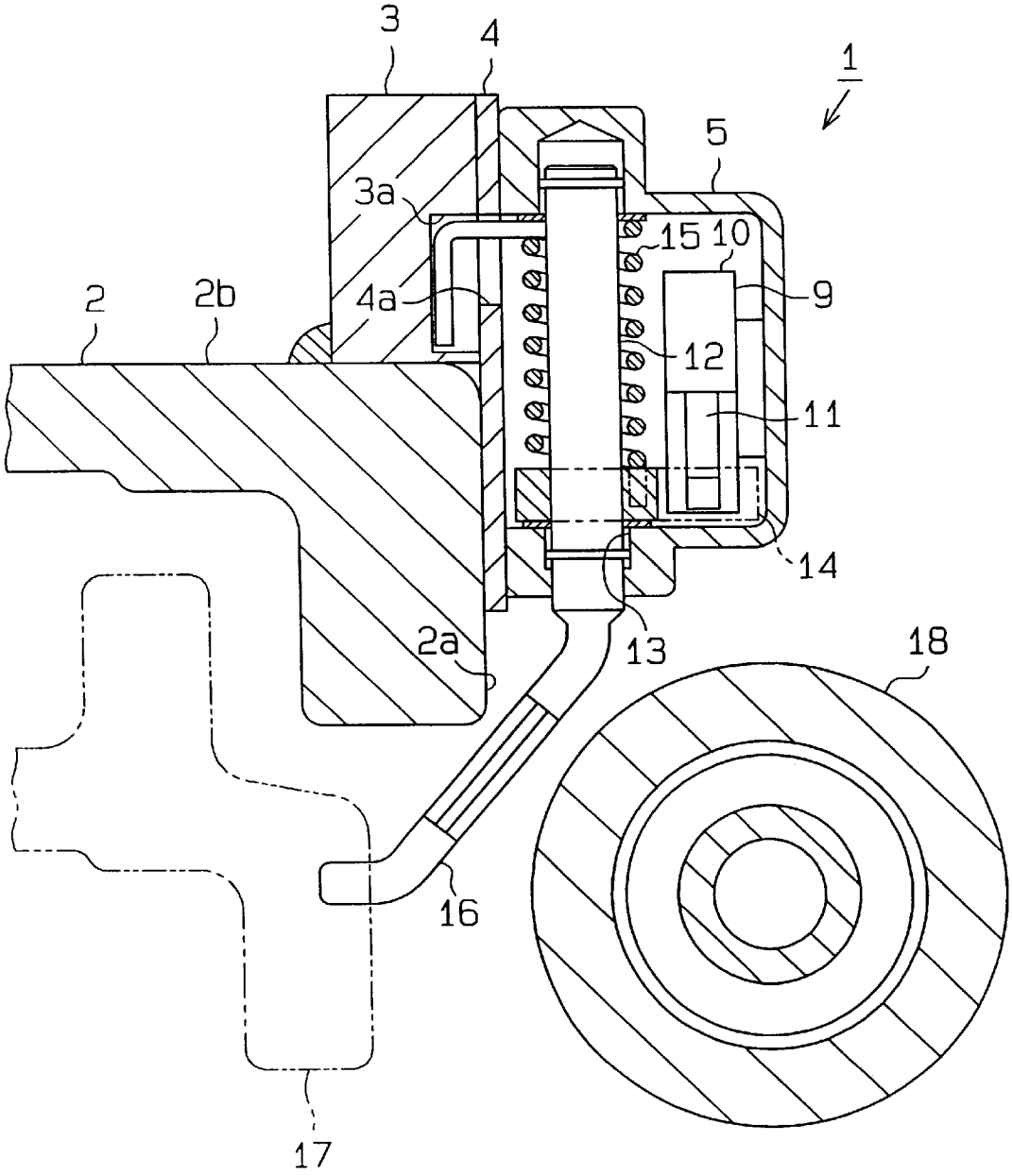
FIG. 1 is a cross-sectional plan view showing a position detecting apparatus according to the present invention.
Figure 2:
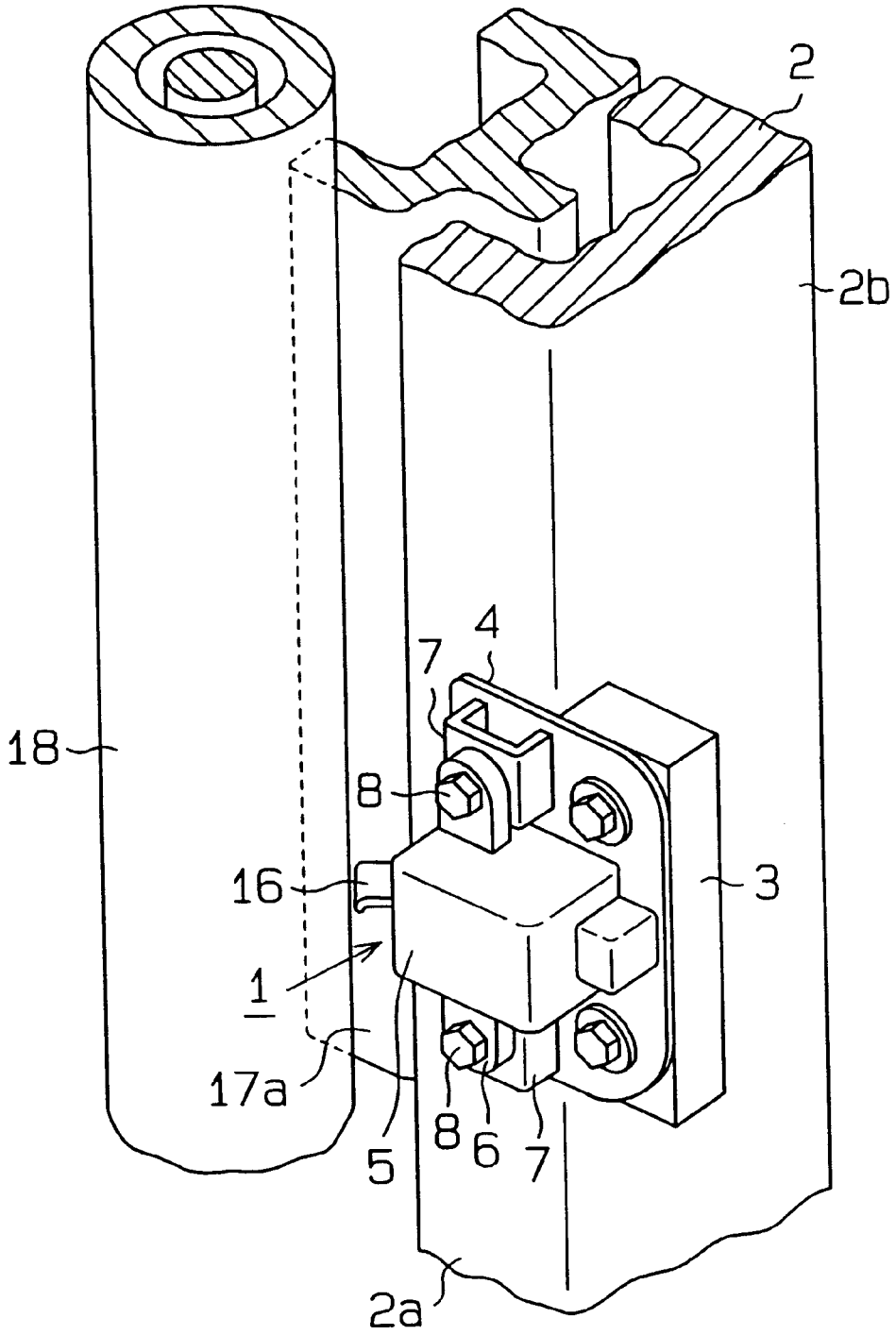
FIG. 2 is a perspective view showing the position detector.
Figure 3:
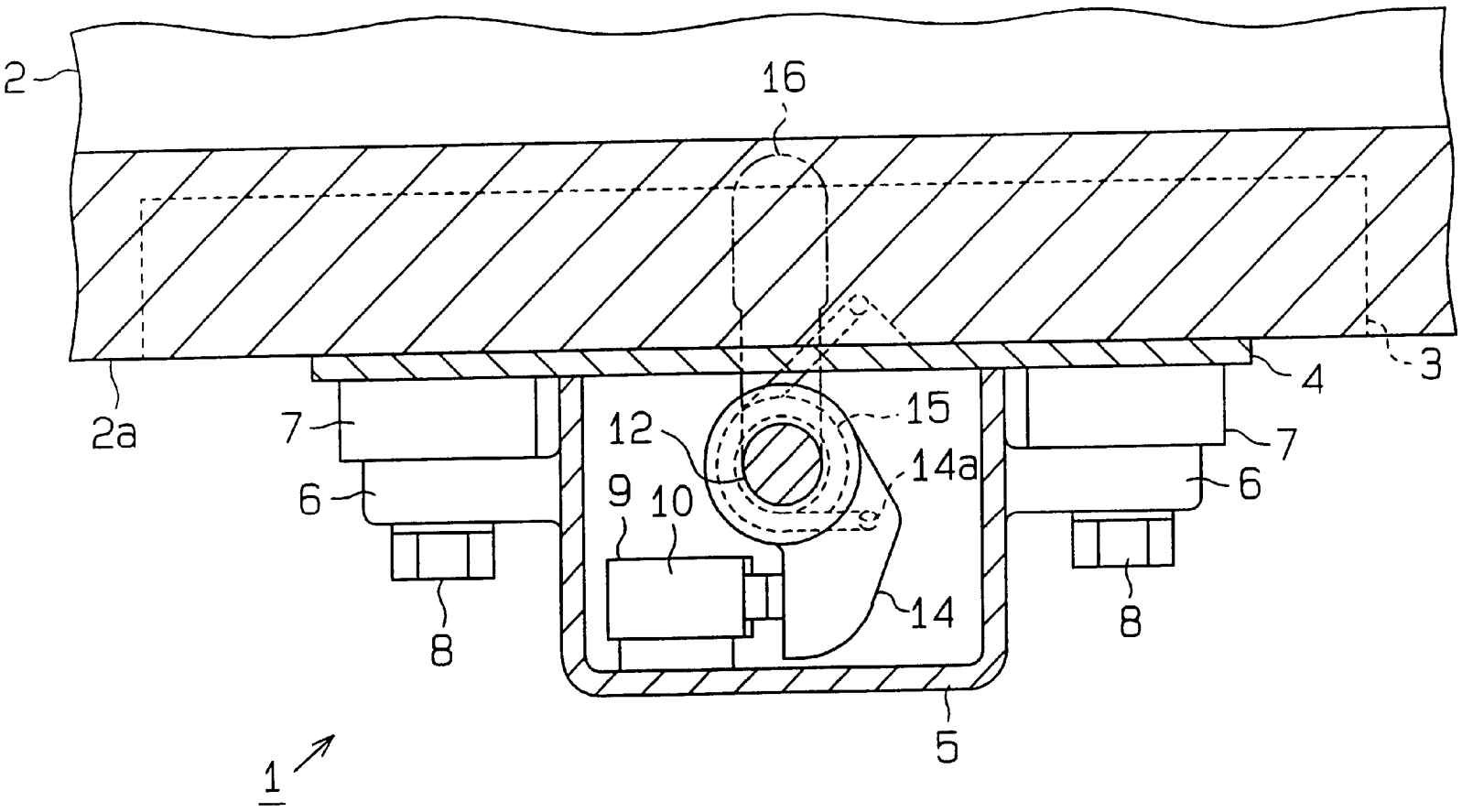
FIG. 3 is a cross-sectional side view showing the position detector.
Figure 4:
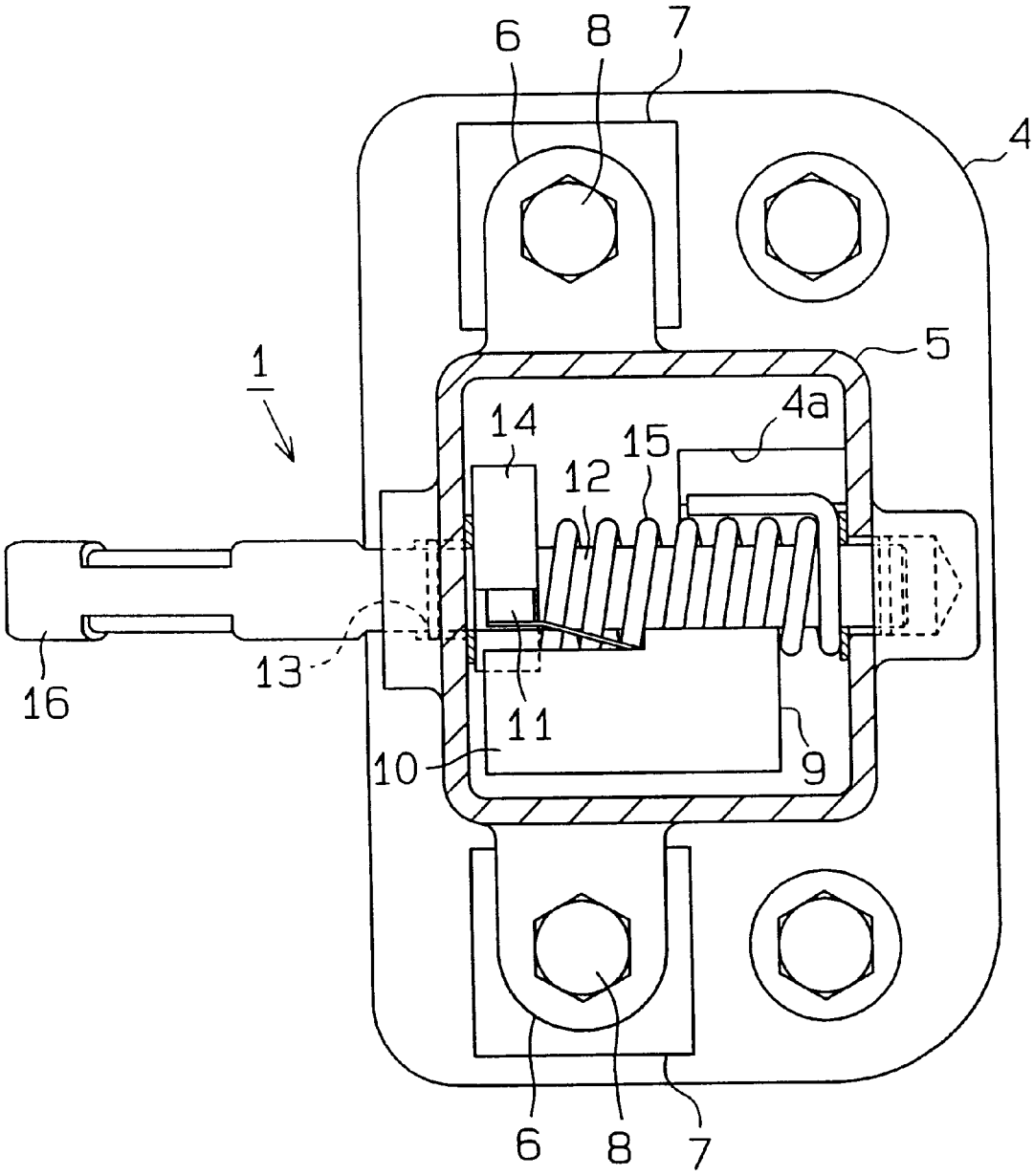
FIG. 4 is a cross-sectional front view showing the position detector.
Figure 6:
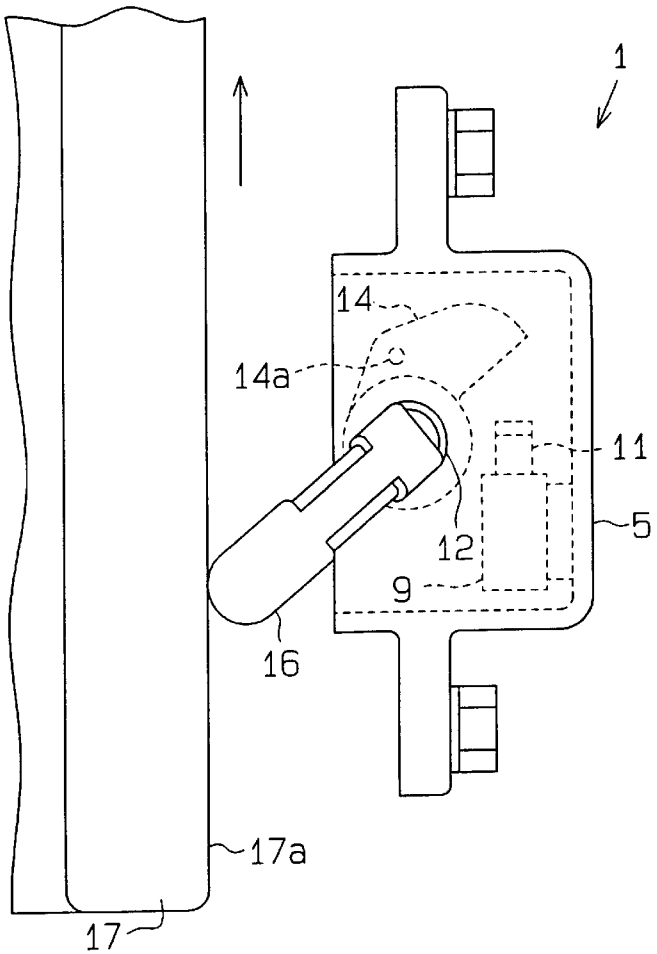
FIG. 6 is a diagrammatic side view showing the operation of the position detector.

As shown in FIGS. 1, 3, and 4, the position detector 1 has a housing 5, which is fixed to the outer mast 2 by the attachment plate 4 and the support plate 3. As shown in FIG. 2, tabs 6, each having a through hole, extend integrally from the top surface and the bottom surface of the housing 5. Each tab 6 is associated with a channel bar 7. The channel bars 7 project from the plate 4 and have threaded holes. A bolt 8 fastens each tab 6 to the associated channel bar 7 to fix the housing 5 to the attachment plate 4.

A microswitch 9 is housed in the housing 5. The microswitch 9 has a body 10, which is fixed to the housing 5, and an arm 11, which projects from the body 10. The body 10 incorporates a switch mechanism (not shown). Manipulation of the arm 11 operates the switch mechanism and actuates the microswitch 9. The arm 11 is located at an actuation position when depressed and is shifted to a de-actuation position by a spring mechanism (not shown) when not pressed. The microswitch 9 is open when the arm 11 is in the de-actuation position and is closed when the arm 11 is in the actuation position. In other words, the microswitch 9 is a normally open type switch.

A shaft 12 extends in the lateral direction of the forklift in the housing 5 and projects outward from the housing 5 through a bore 13. The shaft 12 is supported such that it is pivotal about its axis and is axially movable within a predetermined range. An actuating piece 14 pivots integrally with the shaft 12 to press the arm 11 and actuate the microswitch 9.

Pivoting of the shaft 12 presses the actuating piece 14 against the arm 11. The actuating piece 14 is urged toward the arm 11 by a torsion coil spring 15, which is fitted to the shaft 12. The torsion coil spring 15 also urges the shaft 12 axially to project outward from the bore 13.

The attachment plate 4 has an opening 4*a*, which is connected with a cavity 3*a* defined in the support plate 3. The torsion coil spring 15 has two ends, one of which extends through the opening 4*a* and is held in the cavity 3*a*. The other end is engaged with a hooking hole 14*a*, which is defined in the actuating piece 14, to secure the coil spring 15 to the actuating piece 14.

A lever 16 extends integrally from the shaft 12 toward the inner mast 17. Vertical movement of the inner mast 17 causes the lever 16 to pivot the shaft 12, which actuates or de-actuates the microswitch 9 by means of the actuating piece 14.

A right lift cylinder 18 is located near the outer mast 2. The lever 16 is flat so that it can extend through the narrow space between the outer mast 2 and the lift cylinder 18. The lever 16 has a round end, which decreases the force of the impact when the lever 16 contacts the inner mast 17. The lever end is quenched to harden and enhance its anti-abrasion properties. This prevents wear of the lever 16 when the lever 16 slides against the inner mast 17.

As shown in FIGS. 1, 3, and 4, the torsion coil spring 15 rotates the actuating piece 14 to depress the arm 11 with the inner mast 17 when the lever 16 is disengaged.

Figure 5:
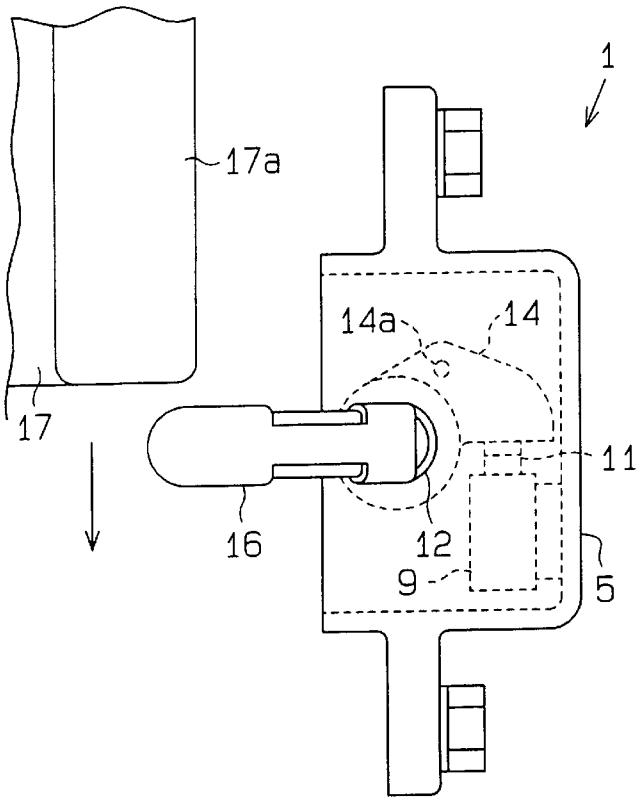
FIG. 5 is a diagrammatic side view showing the operation of the position detector.

The operation of the position detector 1 will now be described. The position detector 1 is actuated when the inner mast 17 enters a detection zone. The lower end of the detection zone is defined by a predetermined actuating position. The position detector 1 is thus attached to the rear surface 2*a* of the right outer mast 2 at a location corresponding to the predetermined actuating position. As shown in FIG. 5, the position detector 1 is arranged such that the shaft 12 extends perpendicular to the moving direction of the inner mast 17 and such that the lever 16 intersects the path of the inner mast 17. In FIG. 5, the lever 16 is disengaged, which depresses the arm 11 and closes the microswitch 9.

When the inner mast 17 is lowered from the detection zone, the inner mast 17 pushes and pivots the lever 16 in a counterclockwise direction (as viewed in FIG. 6) for a predetermined angle. In this state, the round end of the lever 16 slides against a right surface 17*a* of the inner mast 17 as the inner mast 17 moves.

The pivoting of the lever 16 rotates the shaft 12 against the force of the torsion coil spring 15 in a counterclockwise direction (as viewed in FIG. 6) for a predetermined angle. This causes the actuating piece 14 to move away from the arm 11. As a result, the arm 11 is shifted to the de-actuation position by its internal spring mechanism. In other words, the microswitch 9 is opened. The lever 16 keeps the microswitch 9 in an opened state as long as the lower end of the inner mast 17 is located below the detection zone.

When the inner mast 17 is lifted into the detection zone, the lever 16 disengages from the inner mast 17 and pivots back to its original position. Hence, the microswitch 9 is closed. The lever 16 keeps the microswitch 9 in a closed state as long as the inner mast 17 is located in the detection zone.

Accordingly, when the inner mast 17 enters the detection zone, the position detector 1 directly detects the inner mast 17 by means of the lever 16 and the microswitch 9, which is arranged on the outer mast 2 and separated from the inner mast 17.

Figure 7:
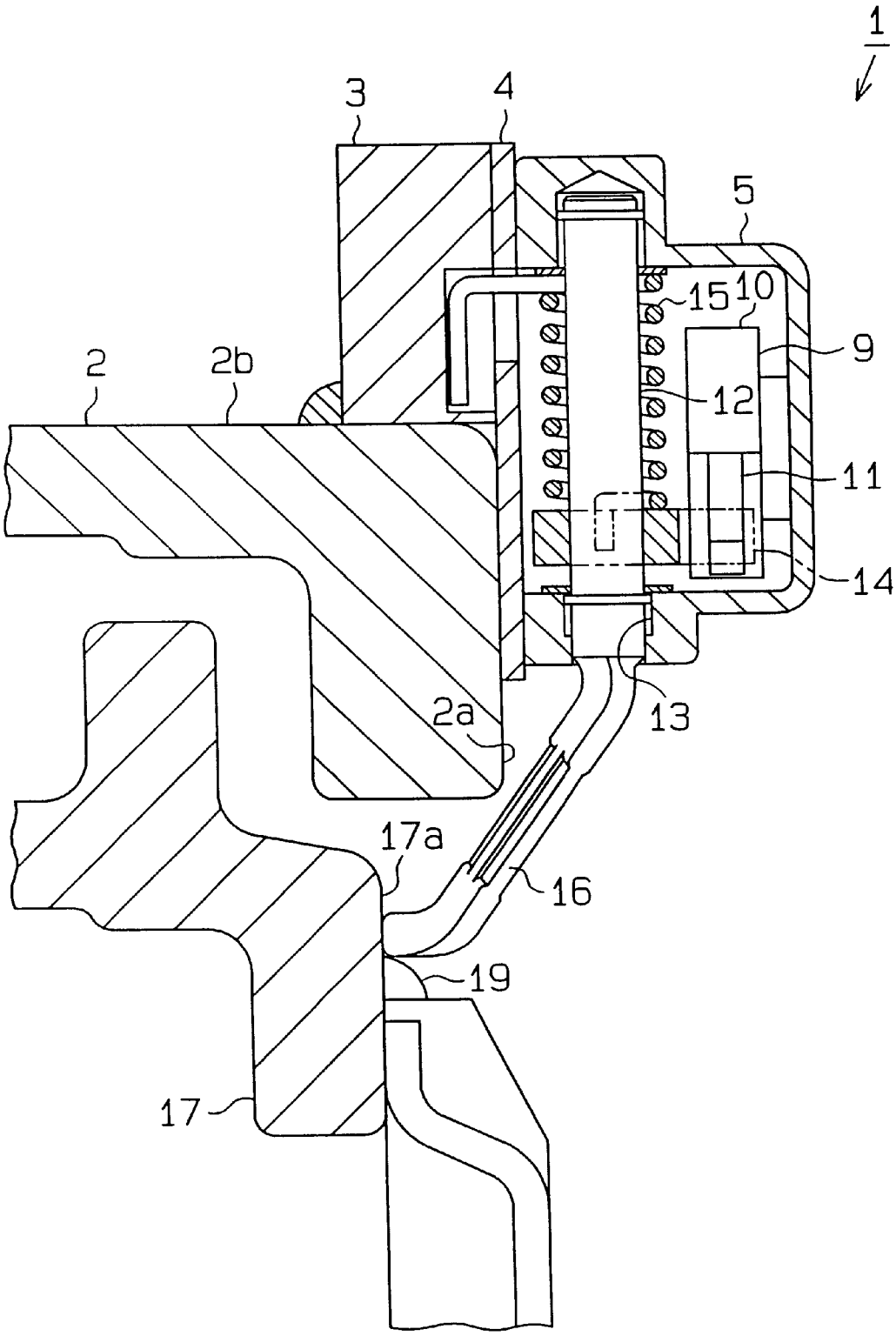
FIG. 7 is a cross-sectional plan view showing the position detector.

The relative distance between the inner mast 17 and the outer mast 2 may vary. However, the torsion coil spring 15 axially moves the shaft 12 to position the lever 16 accordingly. A weld 19 is used for connecting a pair of inner masts by a lower tie beam and an upper tie beam. FIG. 7 shows one of the inner masts 17, an associated tie beam (unnumbered) and the weld 19. When the lever 16 no longer contacts a weld 19 the torsion coil spring 15 axially moves the shaft 12 and returns the lever 16 to its original axial position. Therefore, forces applied to the lever 16 in the axial direction of the shaft 12 are absorbed by the torsion coil spring 15.

The preferred and illustrated embodiment has the advantages described below.

When a detected body (inner mast 17) is moved to a predetermined position (detection zone), the microswitch 9, which is separated from the detected body, directly detects the detected body by means of the lever 16, which operates the microswitch 9.

The force applied to the lever 16 by the detected body (inner mast 17) in the axial direction of the shaft 12 is absorbed by the torsion coil spring 15, which prevents excessive force from acting on the various components of the position detector 1. Thus, detection of the detected body's vertical position is guaranteed even if the detected body has a rough surface.

The torsion coil spring 15, which is fitted to the shaft 12, urges the actuating piece 14 toward the arm 11 and the shaft 12 axially toward the inner mast 17. Accordingly, a single member functions as an actuating mechanism and an urging mechanism. This decreases the number of components and assembling steps.

It should be apparent to those skilled in the art that the present invention may be embodied in many other specific forms without departing from the spirit or scope of the invention. More particularly, the present invention may be embodied as described below.

In the preferred and illustrated embodiment, the position detector 1 is attached to the right outer mast 2. However, the position detector 1 may be attached to the rear surface of a left outer mast as well. Further, the position detector 1 may be secured to the front surface of a right or left inner mast. Accordingly, the location of the position detector 1 is not limited as long as it does not interfere with the handling of loads.

In the preferred and illustrated embodiment, axial movement of the shaft 12 is permitted. However, axial movement of the shaft 12 may be restricted instead. This would also enable direct detection of the right inner mast 17, which moves in a path separated from the right outer mast 2.

Figure 8:
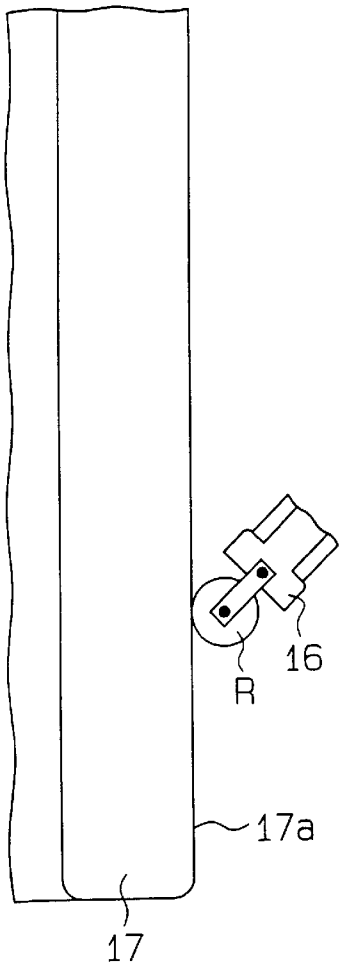
FIG. 8 shows a diagrammatic side view showing a lever employed in a further embodiment according to the present invention.

In a further embodiment according to the present invention, a roller R, which contacts and rolls along the detected body, is secured to the distal end of the lever 16, as shown in FIG. 8. In such case, the lever 16 is manipulated smoothly by the detected body.

Figure 9:
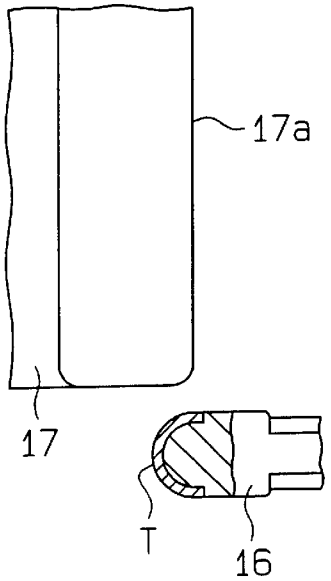
FIG. 9 shows a diagrammatic side view showing a lever employed in a another embodiment according to the present invention.

In another embodiment according to the present invention, a tip T having a high anti-abrasion property may be arranged on the distal end of the lever 16 to slide against the inner mast 17, as shown in FIG. 9.

Therefore, the present examples and embodiments are to be considered as illustrative and not restrictive, and the invention is not to be limited to the details given herein, but may be modified within the scope and equivalence of the appended claims.

What is claimed is:

1. An apparatus mounted on a forklift vehicle for detecting a vertical position of a fork of the forklift vehicle, the vehicle having an outer mast, an inner mast movable in a path parallel to the outer mast, the fork being vertically movable in accordance with vertical movement of the inner mast, the apparatus comprising:

a housing mounted on the forklift vehicle;

a lever displaced when engaged by a lower end of the inner mast when the inner mast is lowered, the lever intersecting the path of the inner mast;

a switch actuated by the lever, the switch disposed within the housing;

a support shaft for supporting the lever, the support shaft being rotatable in a predetermined angular range;

a spring for biasing the support shaft in a first rotational direction, the support shaft being rotated in a second rotational direction, opposite to the first rotational direction, when the lever is engaged by the inner mast; and a switch actuator member located on the support shaft and moving integrally with the support shaft, wherein the switch actuator member actuates the switch when the support shaft is rotated in the first rotational direction, the switch actuator member de-actuating the switch when the support shaft is rotated in the second rotational direction, and wherein said support shaft is axially movable and is biased toward the inner mast.

2. The apparatus as set forth in claim 1, wherein the lever includes an elongated member.

3. The apparatus as set forth in claim 2, wherein the elongated member has a distal end portion that engages the lower end and a side surface of the inner mast.

4. The apparatus as set forth in claim 3, wherein the distal end portion has a roller that engages the inner mast.

5. The apparatus as set forth in claim 3, wherein the distal end portion is semi-circular.

6. The apparatus as set forth in claim 5, wherein the distal end portion is treated with an anti-wearing process.

7. The apparatus as set forth in claim 6, wherein the distal end portion includes a wear-resistant surface.

8. An apparatus mounted on a forklift vehicle for detecting a vertical position of a fork of the forklift vehicle, the vehicle having an outer mast, an inner mast movable in a path parallel to the outer mast, the fork being vertically movable in accordance with vertical movement of the inner mast, the apparatus comprising;

a housing secured to a rear surface of the outer mast;

a lever displaced when engaged by a lower end of the inner mast when the inner mast is lowered, the lever-intersecting the path of the inner mast;

a support shaft for supporting the lever, wherein the support shaft is supported by the housing, the support shaft being rotatable in a predetermined angular range between an initial position and an operation position;

a spring for biasing the support shaft in a first rotational direction, the support shaft being rotated in a second rotational direction, opposite to the first rotational direction, when the lever is engaged by the inner mast;

a switch actuated by the lever, the switch disposed within the housing; and a switch actuator member located on the support shaft and moving integrally with the support shaft, wherein the switch actuator member actuates the switch when the support shaft is rotated in the first rotational direction, the switch actuator member de-actuating the switch when the support shaft is rotated in the second rotational direction, and wherein the support shaft is axially movable and is biased toward the inner mast.

9. The apparatus as set forth in claim 8, wherein the lever includes an elongated member.

10. The apparatus as set forth in claim 9, wherein the elongated member has a distal end portion that engages the inner mast.

11. The apparatus as set forth in claim 10, wherein the distal end portion has a roller that engages the inner mast.

12. The apparatus as set forth in claim 10, wherein the distal end portion is semi-circular.

13. The apparatus as set forth in claim 12, wherein the distal end portion is treated with an anti-wearing process.

14. The apparatus as set forth in claim 13, wherein the distal end portion includes a wear resistant surface.

15. An apparatus for detecting a vertical position of a fork of a forklift vehicle, the vehicle having an outer mast, an inner mast movable in a path parallel to the outer mast, the fork being vertically movable in accordance with vertical movement of the inner mast, the apparatus comprising:

a housing;

a lever engageable with the inner mast when the inner mast is located in a predetermined vertical region, the lever being capable of being pivotally displaced about an axis when engaged by the inner mast;

a switch disposed within the housing;

a support shaft supporting the lever, the support shaft being rotatable about its axis within a predetermined angular range in response to the pivotal displacement of the lever, and being axially movable within a predetermined range in response to a force applied to the lever in the axial direction of the shaft;

a spring for biasing the support shaft in a first rotational direction, the support shaft being rotated in a second rotational direction, opposite to the first rotational direction, when the lever is pivotally displaced in the second rotational direction, and for biasing the support shaft in an axial direction opposite to the direction of the force applied to the lever and absorbing the force; and a switch actuator member located on the support shaft and movable integrally with the support shaft, wherein the switch actuator member actuates the switch when the support shaft is rotated in the first rotational direction, the switch actuator member de-actuating the switch when the support shaft is rotated in the second rotational direction.

* * * * *

UNITED STATES PATENT AND TRADEMARK OFFICE

CERTIFICATE OF CORRECTION

PATENT NO. : 6,140,594
DATED : October 31, 2000
INVENTOR(S) : Kazuo Ishikawa

It is certified that error appears in the above-identified patent and that said Letters Patent is hereby corrected as shown below:

Column 4,
Line 27, after "19" please insert -- , --;

Column 5,
Lines 64-65, please change "lever-intersecting" to -- lever intersecting --.

Signed and Sealed this

Twenty-sixth Day of March, 2002

*Attest:*

*Attesting Officer*

JAMES E. ROGAN
*Director of the United States Patent and Trademark Office*